United States Patent [19]

Tsuji

[11] Patent Number: 4,618,247

[45] Date of Patent: Oct. 21, 1986

[54] PHOTORECEPTOR PRE-INITIALIZING ELECTROPHOTOGRAPHIC COPYING MACHINE

[75] Inventor: Masaru Tsuji, Nara, Japan

[73] Assignee: Sharp Kabushiki Kaisha, Osaka, Japan

[21] Appl. No.: 678,831

[22] Filed: Dec. 6, 1984

[30] Foreign Application Priority Data

Dec. 9, 1983 [JP] Japan ..... 58-233287

[51] Int. Cl.[4] ..... G03G 15/20

[52] U.S. Cl. ..... 355/14 FU; 355/3 FU

[58] Field of Search ..... 355/14 FU, 3 FU; 219/216, 388; 430/60

[56] References Cited

U.S. PATENT DOCUMENTS

| | | | |
|---|---|---|---|
| 4,113,375 | 9/1978 | Murata et al. | 355/14 FU |
| 4,372,675 | 2/1983 | Sahay | 355/14 FU |
| 4,373,802 | 2/1983 | Yuge et al. | 219/216 X |
| 4,493,984 | 1/1985 | Yamauchi | 219/216 X |
| 4,512,649 | 4/1985 | Derimiggio | 355/14 FU |

*Primary Examiner*—R. L. Moses

*Attorney, Agent, or Firm*—Birch, Stewart, Kolasch & Birch

[57] ABSTRACT

An electrophotographic copying machine comprises a copy-image forming member for enabling the machine to conduct a copy operation to provide a toner image onto a copy paper, a heat-fixing element responsive to the copy-forming member for heat-fixing the toner image to the copied paper, a heater for heating the heat-fixing element up to a toner-fixing temperature of fixing the toner image on the copied paper, a detection member for detecting that the heat-fixing element is prior to the toner temperature, and an initializing member responsive to the detection member for starting to initialize a photoreceptor, so that the copy-image forming member and the heat-fixing member follow the operation of the initializing member to thereby start the copy operation.

3 Claims, 2 Drawing Figures

PHOTORECEPTOR PRE-INITIALIZING ELECTROPHOTOGRAPHIC COPYING MACHINE

BACKGROUND OF THE INVENTION

The present invention relates to an electrophotographic copying machine and, more particularly, to an electrophotographic copying machine of a heat-fixing type.

A conventional electrophotographic copying machine of a heat-fixing type comprises a heat-fixing roller which is heated in response to power supply. At the time when the fixing roller is heated at a predetermined temperature, i.e., a toner-fixing temperature, a photoreceptor of the copying machine is started to be rotated accompanied by removal unnecessary charges from itself and cleaning itself. Thereafter, a display is illuminated indicating that copying becomes possible. In response to the illumination of the display, the operator actuates a copy start switch so that after the second completion of the charge-removing and the cleaning operations, an actual copying operation comprising charging, light exposure, developing, and transferring is started. Thus, the conventional copying machine needs a considerably long time from the power supply to the start of the actual copying operation.

This is due to the fact that the charge-removing and the cleaning operations are repeated twice from the time when the heat-fixing roller is heated at the toner-fixing temperature to the time of actually conducting the copy operation.

SUMMARY OF THE INVENTION

Accordingly, it is an object of the present invention to provide an improved electrophotographic copying machine for enabling a rapid copying operation.

It is another object of the present invention to provide an improved electrophotographic copying machine of a heat-fixing type for detecting that a copy-possible condition will soon be available.

It is a further object of the present invention to provide an improved detection means for an electrophotographic copying machine for detecting that a heat-fixing roller of the copying machine will be heated prior to reaching a toner-fixing temperature so that in response to the detection of the detection means, a photoreceptor is initialized.

Briefly described, in accordance with the present invention, an electrophotographic copying machine comprises copy-image forming means for enabling the machine to conduct a copy operation to provide a toner image onto a copy paper, heat-fixing means responsive to the copy-image forming means for heat-fixing the toner image to the copied paper, heating means for heating the heat-fixing means up to a toner-fixing temperature for fixing the toner image on the copied paper, detection means for detecting that the heat-fixing means is operative prior to reaching the toner-fixing temperature, and initializing means responsive to the detection means for starting to initialize a photoreceptor, so that the copy-image forming means and the heat-fixing means follow the operation of the initializing means to thereby start the copy operation.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
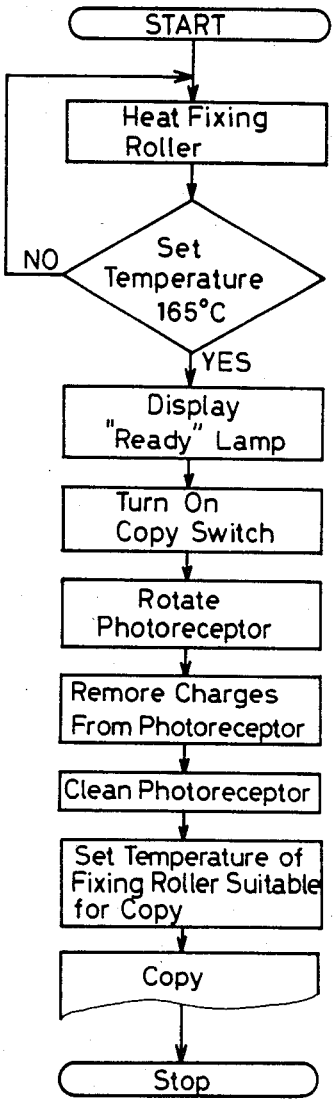
FIG. 1 is a flow chart of the operation of an electrophotographic copying machine including heat control means according to the present invention.
Figure 2:
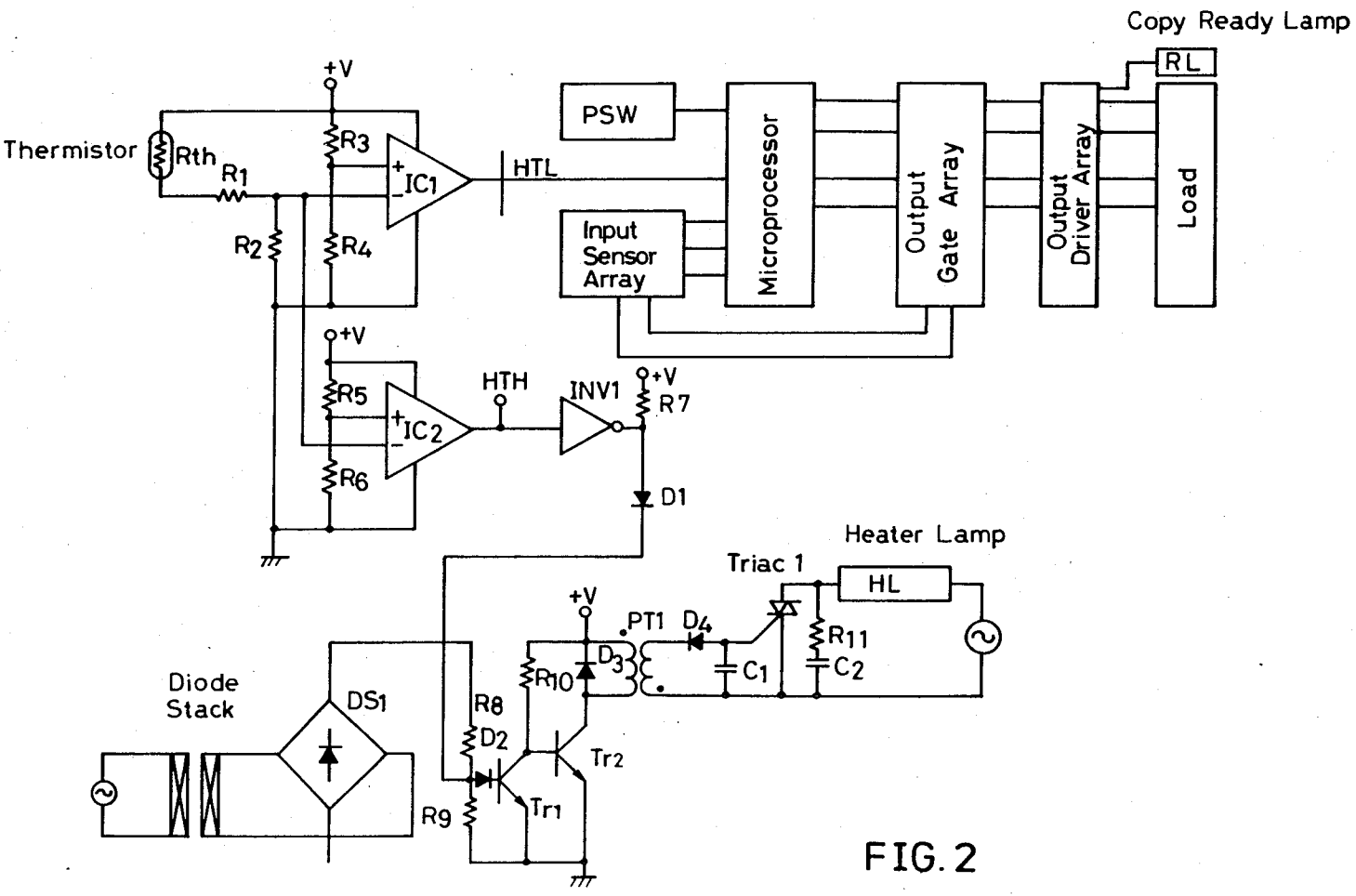
FIG. 2 is a block diagram of a circuit of the heat control means of the present invention.

FIG. 1 is a flow chart of the operation of an electrophotographic copying machine including heat control means according to the present invention; FIG. 2 is a block diagram of a circuit of the heat control means.

The following are some specifications of the copying machine used for the present invention.

Toner-fixing temperature (control temperature): "T" degrees Centigrade

Ratio of heating a heat-fixing roller: "a" (degrees Centigrade/sec)

Surrounding temperature: "b" (degrees Centigrade)

Process speed: "c" (mm/sec)

Peripheral length of a photoreceptor drum: "d" (mm)

The following temperature A (degrees Centigrade) is defined to be a temperature at which the copy-ready display is displayed to indicate that a copying operation is possible: $A=T-a\times d/c$ (provided that charge-removing and cleaning operations can be completed when the photoreceptor is fully rotated once)

A time B (sec) for reaching the temperature A (degrees Centigrade) after a main power switch of the copying machine is operated is calculated as follows: $B=(A-b)/a$ At the time B after the start of the power supply to the machine, the copy-ready display is started to be displayed.

That is, in accordance with a preferred embodiment of the present invention, the copying machine is of a heat-fixing type comprising a heat-fixing roller and an idle roller. The heat-fixing roller is heated at a toner-fixing temperature and stresses a copied paper to press and fix the toner image on the copied paper. While the charge-removing from the photoreceptor and the photoreceptor-cleaning operations are conducted only once following the rotation of the photoreceptor for initializing purpose in response to a copy start, the heat-fixing roller is heated up to the toner-fixing temperature. At the time when the charge-removing and the cleaning operations are completed for the first time, the heat-fixing roller is heated to be at the toner-fixing temperature. Thus, the conventional double operations for the charge-removing and the cleaning can be eliminated.

In other words, a copy-ready display illuminated for indicating the copy-OK condition is started to be displayed at a time of subtracting a time, by which the charge-removing and the cleaning operations can be completed once, from the total time of heating the heat-fixing roller up to the possible set toner-fixing temperature.

It will be evident that the copy-ready display can be replaced by any other alarm means such as a voice synthesizer or the like. Further, it may be apparent that a copy paper is transported and positioned adjacent the photoreceptor just before the start of the actual copy operations.

Now, the preferred embodiment of the present invention will be described as follows:

Specific values of the specifications are assumed as shown in TABLE 1.

TABLE I

| Character | Value |
|---|---|
| T | about 180 |
| a | about 5 |
| b | about 20 |
| c | about 150 |
| d | about 450 |

Under the above-specified condition, the temperature A is calculated as follows:

$$A=180-5\times(450/150)=165(\text{degrees Centigrade})$$

The time B from a time of starting power supply to the copying machine to a time of the temperature A is calculated as follows:

$$B=(165-20)/5=29(\text{sec})$$

If the conventional copying machine is operated in the same condition, the following times should be calculated:

Time from the surrounding temperature to the toner-fixing temperature after the start of the power supply $=(180-20)/5=32$(sec), and Time necessary for the charge-removing and the cleaning operations after reaching the toner-fixing temperature$=(450/150)=3$(sec): The total time is 35 (sec) before the copy-ready display is started to be displayed after the start of power supply to the copying machine.

Thus, it is evident that the start of the copy-ready display illumination, i.e., the starting operation of the copying machine of the present invention is rapid.

As stated above, in the preferred embodiment of the present invention, the charge-removing and the cleaning operations are conducted only once for initializing purposes during which the fixing roller is heated up to the toner-fixing temperature.

Of course, also in the preferred embodiment of the present invention, once the fixing roller is heated at the toner-fixing temperature, the true copying operations comprising the charging, light-exposure, developing, coronatransference, and toner-fixing should be conducted as shown by the "copy" step of FIG. 1 so that little image-forming, fixing, and copy property can be lowered.

FIG. 2 is a block diagram of a heat control circuit for the copying machine according to the present invention.

The circuit of FIG. 2 comprises a thermistor Rth, eleven resistances R1 to R11, two comparators IC1 and IC2, an inverter IN1, a copy switch PSW, an input sensor array, a microprocessor, an output gate array, an output driver array, a load, a copy-ready lamp RL, a diode stack DS1, four diodes D1 to D4, two transistors Tr1 and Tr2, a pulse transformer PT1, a triac 1, two condensers C1 and C2, a heater lamp HL, and power source means.

The thermistor Rth is provided for detecting the temperature of the heat fixing roller since its resistance is low as the temperature is raised.

In connection with FIG. 2, the characters as used herein are defined as follows:

T: a temperature detected by the thermistor Rth $T_L$: a lower set temperature (in the preferred embodiment, about 165 degrees Centigrade)

$R_{thL}$: the resistance of the thermistor Rth when the heat-fixing roller is at $T_L$ $T_H$: a higher set temperature (in the embodiment, about 180 degrees Centigrade) corresponding to the toner-fixing temperature $R_{thH}$: the resistance of the thermistor Rth when the heat-fixing roller is at $T_H$ HTL in FIG. 2: a heater temperature low signal indicating that the temperature of the heat-fixing roller is too low to fix the toner to the copied paper HTH in FIG. 2: a heater temperature high signal indicating that the temperature of the heat-fixing roller is so high as to fix the toner to the copied paper The relations between the HTL and the HTH are summarized as shown in TABLE II.

TABLE II

| Case | HTL | HTH |
|---|---|---|
| (1) $T < T_L$ | H | H |
| (2) $T_L < T < T_H$ | L | H |
| (3) $T_L < T_H < T$ | L | L |

(1) When $T<T_L$:

This condition corresponds to the following situation:

$$(Rth+R1)/(R1+R2+Rth)>R3/(R3+R4)$$

$$(Rth+R1)/(R1+R2+Rth)>R5/(R5+R6)$$

When the HTH develops is generated and a high level signal "H", the signals rectified over their full waves by the diode stack DS1 are amplified by the transistors Tr1 and Tr2 and sent into a gate of the triac 1 through the pulse transformer PT1. The triac 1 is switched on to thereby switch on the heater lamp HL. As far as the HTL is generated and the high level signal "H", the microprocessor prevents the copyready lamp RL from being displayed.

(2) $T_L<T<T_H$:

This condition corresponds to the following status:

$$(Rth+R1)/(R1+R2+Rth)<R3/(R3+R4)$$

$$(Rth+R1)/(R1+R2+Rth)>R5/(R5+R6)$$

Similarly with the above case (1), the heater lamp HL is switched on. However, when the HTL is generated and a low level signal "L"is generated, the microprocessor permits the copy-ready lamp RL to be switched on to await the actuation of the copy switch PSW as far as it is detected that the other conditions are normal, e.g., the document table is stopped at its normal position and the master paper is normally positioned or the like.

(3) $T_L<T_H<T$:

This condition corresponds to the following status:

$$(Rth+R1)/(R1+R2+Rth)<R3/(R3+R4)$$

$$(Rth+R1)/(R1+R2+Rth)<R5/(R5+R6)$$

In this case, the output of the inverter INV1 is a high level signal "H", so that the transistor Tr1 is switched on and the transistor Tr2 is switched off. Since no gate pulse is inputted into the triac 1, the heater lamp HL is switched off. Therefore, the heater lamp HL is controlled so as to keep the temperature $T_H$(about 180 degrees Centigrade). As the low level signal "L" of the HTL is inputted into the microprocessor, the copying operations are continued.

The microcomputer can calculate the values A and B. Preferably, such a microcomputer used for FIG. 2 may comprise input means for inputting the values "T", "a", "b", "c", and "d", calculating means for calculating the values A and B, counter means for counting a time after the power application to the copying machine, memory means for storing the results of the calculating means, and output means for outputting a pulse when the time B passes. The copy-ready lamp RL is provided in the copying machine, serving to display the copy-O.K. indication in response to the application of the pulse from the output means.

While only certain embodiments of the present invention have been described, it will be apparent to those skilled in the art that various changes and modifications may be made therein without departing from the spirit and scope of the present invention as claimed.

What is claimed is:

1. A photoreceptor initialization device in an electrophotographic copying machine, said device comprising:

copy-image forming means for enabling said copying machine to perform a copying operation by providing a toner image onto a copy paper;

heat-fixing means for heat-fixing said toner image onto said copy paper in said copying operation;

means for heating said heat-fixing means to a predetermined toner fixing temperature;

detecting means for determining that said heat-fixing means is being heated prior to said heat-fixing means reaching said predetermined toner fixing temperature;

means for initializing the photoreceptor in response to said detecting means determining that said heat-fixing means is being heated;

said copy-image forming means for enabling said copying machine being activated subsequent to initializing the photoreceptor and prior to said heat-fixing means reaching said predetermined toner fixing temperature.

2. The of claim 1, wherein said detecting means comprises a temperature detection element for sensing the temperature of said heat-fixing means, comparator means for comparing the sensed temperature of said heat-fixing means with first and second predetermined temperatures and providing output signals representative thereof, and a microprocessor, said microprocessor including a calculating circuit, a counting circuit, and a pulse outputting circuit.

3. The device of claim 1, wherein said predetermined toner-fixing temperature is about 180 degrees Centigrade, said means for initializing the photoreceptor being activated when said detecting means determines that said heat-fixing means is at a temperature of about 165 degrees Centigrade.

* * * * *